US005632566A

United States Patent [19]

Korzilius et al.

[11] Patent Number: 5,632,566

[45] Date of Patent: May 27, 1997

[54] APPARATUS TO RETAIN AND REINFORCE NOTEBOOK CONTENTS

[75] Inventors: Bruce P. Korzilius; Erik V. Korzilius, both of Tallahassee, Fla.

[73] Assignee: Universal Marketing and Distributing Incorporated, Venice, Fla.

[21] Appl. No.: 517,386

[22] Filed: Aug. 21, 1995

[51] Int. Cl.[6] ..... B42F 13/00

[52] U.S. Cl. ..... 402/79; 281/20; 281/45; 281/42

[58] Field of Search ..... 402/79, 73; 281/15.1, 281/20, 29, 34, 36, 38, 42, 45

[56] References Cited

U.S. PATENT DOCUMENTS

| | | | |
|---|---|---|---|
| 1,562,320 | 11/1925 | Farley | 281/29 |
| 2,732,842 | 1/1956 | Loudon | 281/45 |
| 3,898,951 | 8/1975 | Clare | 281/42 |
| 4,503,974 | 3/1985 | Lane | 281/20 |
| 4,531,764 | 7/1985 | Chang | 281/29 |
| 4,744,689 | 5/1988 | Sternberg | 402/73 |
| 4,997,207 | 3/1991 | Feldman | 402/73 |
| 5,067,748 | 11/1991 | Wernquest | 281/48 |
| 5,069,567 | 12/1991 | Fink et al. | 402/3 |
| 5,222,765 | 6/1993 | Pileggi | 281/45 |
| 5,267,804 | 12/1993 | Baumgarten | 402/73 |

FOREIGN PATENT DOCUMENTS

| | | | |
|---|---|---|---|
| 522669 | 4/1931 | Germany | 281/45 |
| 804798 | 4/1951 | Germany | 281/20 |

*Primary Examiner*—David P. Bryant

[57] ABSTRACT

The invention, consisting of two (2) flat, rectangular, pre-slotted, backing boards with the anterior backing board containing six (6) Velcro® receiving strips (hooks) affixed in a parallel manner, an equal number above and below the centerline, and the posterior backing board containing between two (2) and six (6) binding straps with one (1) end of the binding strap being permanently affixed to the posterior backing board, with an equal number affixed above and below the centerline, and to be affixed to the Velcro® receiving strips (hooks) affixed to the anterior backing board, is to be utilized in retaining and reinforcing the loose-leaf pages or contents of multi-ring notebook binders, whether the binders utilize a "C" ring, "D" ring, "Slant" ring or other edge binding technology.

8 Claims, 5 Drawing Sheets

APPARATUS TO RETAIN AND REINFORCE NOTEBOOK CONTENTS

GOVERNMENT RIGHTS

No pre-existing government rights exist under federally sponsored research and development in relation to the below specified invention.

CROSS-REFERENCES

There are no cross-references to any pre-existing specifications, patent applications, or issued patents in relation to the below specified invention. The only prior art that may be applicable to the below specified invention would involve the notebooks, or other loose-leaf page organizer or binder with which the invention is to be utilized, or the usage of Velcro® in constructing the binding strap fasteners.

BACKGROUND

Currently, there does not exist an apparatus to retain and reinforce the loose-leaf pages or contents of multi-ring notebook binders, whether the binders utilize a "C"-ring, "D"-ring, "Slant"-ring or other edge binding technology, when the multi-ring notebook binder is placed on its end, or in the "portrait" position. This involves a significant problem because the only spatially efficient manner in which to store multi-ring notebook binders is on their ends, or in the "portrait" position. When the multi-ring notebook binders are placed on their ends, or in the "portrait" position, the loose-leaf pages or contents of the binders tend to slide down due to the force of gravity, and either warp or tear out of the binder leading to costly damage and repair expense to the loose-leaf pages or contents of the binder. The foregoing circumstance could be resolved by the use of an apparatus that could retain and reinforce the loose-leaf pages or contents of multi-ring notebook binders, whether the binders utilize a "C"-ring, "D"-ring, "Slant"-ring or other edge binding technology.

There is no current solution to the instance wherein the loose-leaf pages or contents of multi-ring notebook binders are torn, warped or otherwise damaged when the multi-ring notebook binders are placed on a bookshelf on their ends, on in the "portrait" position. For the foregoing reasons, there is an immediate need for an apparatus capable of retaining and reinforcing the loose-leaf pages or contents of multi-ring notebook binders, whether the binders utilize a "C"-ring, "D"-ring, "Slant"-ring or other edge binding technology.

SUMMARY

The present invention is directed to an apparatus that is capable of retaining and reinforcing the loose-leaf pages or contents of multi-ring notebook binders, whether the binders utilize a "C"-ring, "D"-ring, "Slant"-ring or other edge binding technology.

The invention, consisting of two (2) flat, rectangular, pre-slotted, backing boards, with the anterior backing board containing six (6) Velcro® receiving strips (hooks) affixed in a parallel manner, an equal number above and below the centerline, and the posterior backing board containing between two (2) and six (6) binding straps with one (1) end of the binding strap being permanently affixed to the posterior backing board, with an equal number affixed above and below the centerline, and the binding strap being of sufficient length so as to allow the opposing end of the binding strap containing a Velcro® fastener (loop) to be affixed to the Velcro® receiving strips (hooks) affixed to the anterior backing board, is to be utilized in retaining and reinforcing the loose-leaf pages or contents of multi-ring notebook binders, whether the binders utilize a "C"-ring, "D"-ring, "Slant"-ring or other edge binding technology.

The invention will also have two (2) categories of variations and there will be two (2) different models, Economy and Deluxe within each category of variations.

The two (2) main categories of variations involve the type of binding technology to be utilized in the notebook binder. The first variation is designed to be utilized in notebook binders utilizing either "C"-ring or "D"-ring technology. The second variation is designed to be utilized in notebook binders utilizing "Slant"-ring technology. The two (2) subcategories of variations involve the type of loose-leaf pages or contents of the notebook binder.

The Economy Model will contain two (2) flat, rectangular, pre-slotted, backing boards, with the anterior backing board containing six (6) Velcro® receiving strips (hooks) affixed in a parallel manner, with three (3) above the centerline of the anterior backing board, and three (3) below the centerline of the anterior backing board, and the posterior backing board containing six (6) binding straps with one (1) end of each of the six (6) binding straps being permanently affixed to the posterior backing board, three (3) binding straps affixed to the posterior backing board above the centerline of the posterior backing board, and the other three (3) binding straps affixed to the posterior backing board below the centerline of the posterior backing board, and to be affixed to the Velcro® receiving strips (hooks) affixed to the anterior backing board. There will be six (6) Velcro® receiving strips (hooks) permanently affixed to the posterior backing board with an equal number located directly above and below the centerline of the posterior backing board, upon which the six (6) Velcro® fasteners (hoops) on the ends of the six (6) binding straps may be stored when not in use.

The Deluxe Model will contain two (2) flat, rectangular, pre-slotted, backing boards, with the anterior backing board containing six (6) Velcro® receiving strips (hooks) affixed in a parallel manner, three (3) above and three (3) below the centerline of the anterior backing board, and the posterior backing board containing two (2) binding straps with one (1) end of each of the two (2) binding straps being permanently affixed to the posterior backing board, one (1) binding strap affixed above the centerline of the posterior backing board, and the other binding strap affixed below the centerline of the posterior backing board, and to be affixed to the Velcro® receiving strips (hooks) affixed to the anterior backing board. There will be six (6) Velcro® receiving strips (hooks) permanently affixed to the posterior backing board, with an equal number located directly above and below the centerline of the posterior backing board, upon which the six (6) Velcro® fasteners (hoops) on the ends of the two (2) binding straps may be stored when not in use.

BRIEF DESCRIPTION OF THE DRAWINGS

These and other features, aspects, and advantages of the present invention will become better understood with regard to the following description, appended claims, and accompanying drawings, where:

FIGURES

Figure 1:
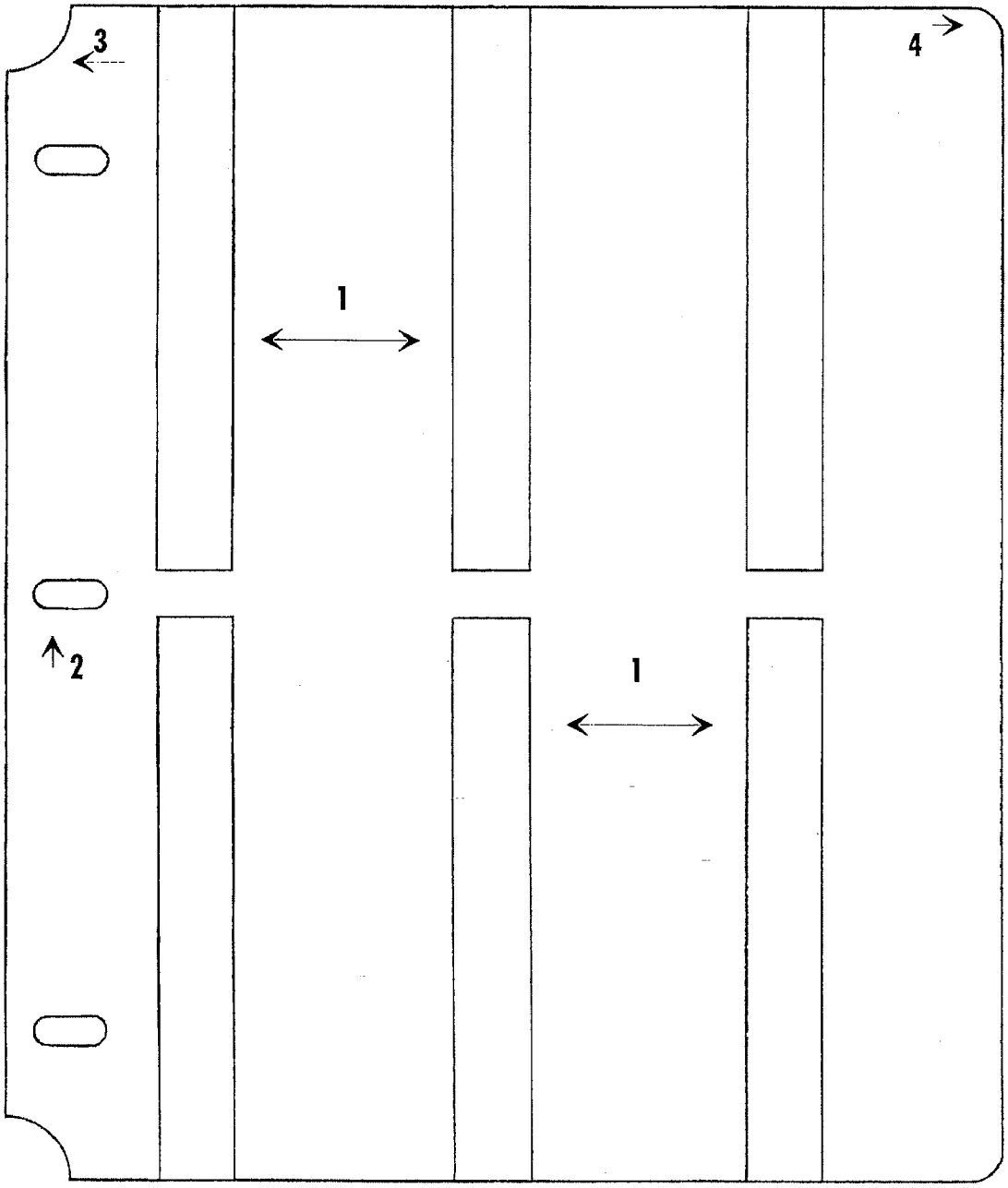

FIG. 1 shows an aerial view of the front portion of the anterior backing board of the apparatus as configured for the Economy Model to be utilized with multi-ring notebook binders utilizing either "C"-ring or "D"-ring binding technology.

Figure 2:
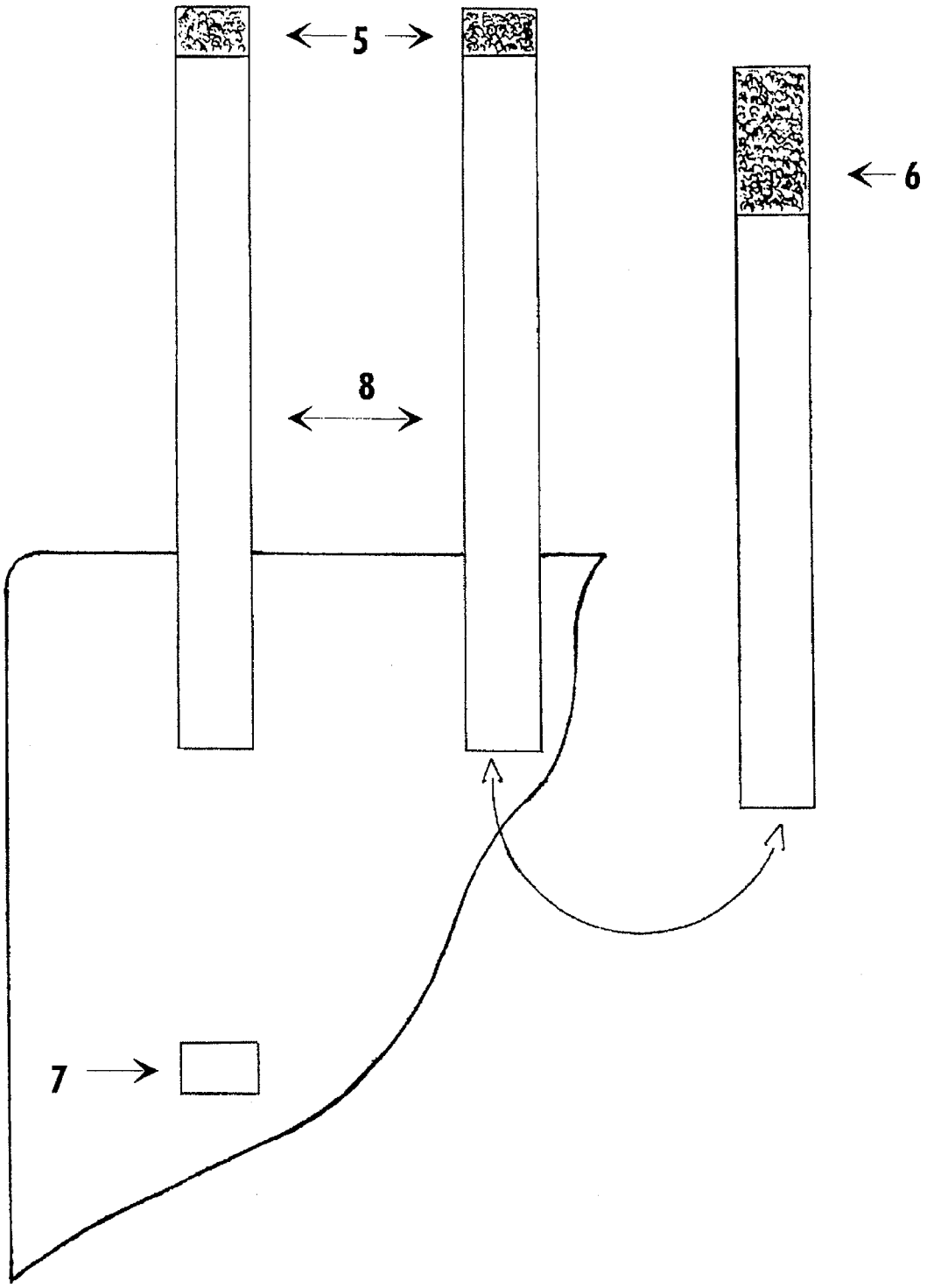

FIG. 2 shows an aerial view of a representative segment of the rear portion of the posterior backing board of the apparatus as configured for the Economy Model to be utilized with multi-ring notebook binders utilizing either "C"-ring or "D"-ring binding technology, including an aerial view of the reverse side of the binding strap.

Figure 3:
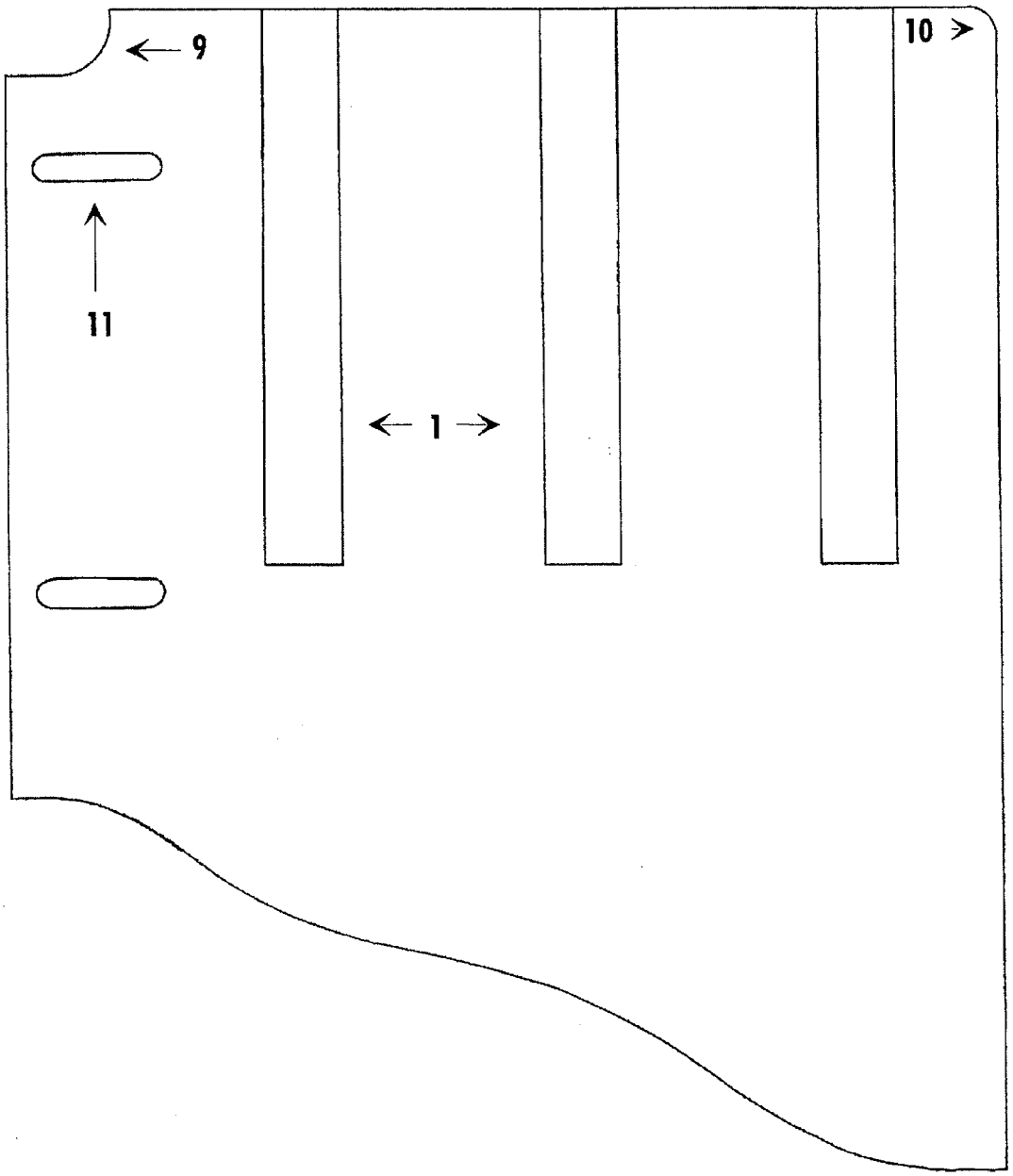

FIG. 3 shows an aerial view of a representative segment of the front portion of the anterior backing board of the apparatus as configured for the Economy Model to be utilized with multi-ring notebook binders utilizing "Slant"-ring binding technology.

Figure 4:
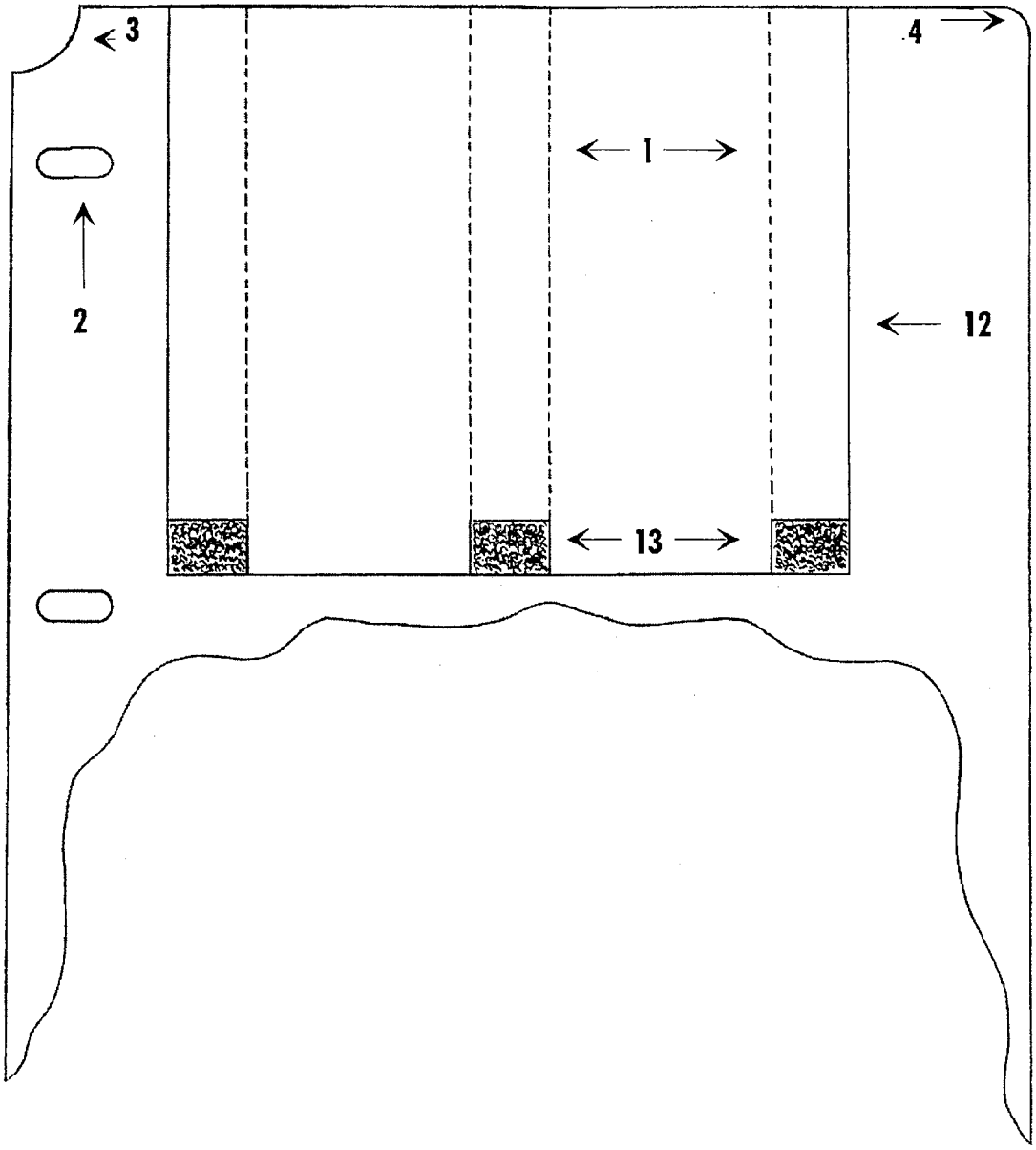

FIG. 4 shows an aerial view of the Deluxe binding strap affixed to a representative segment of the front portion of the anterior backing board of the apparatus to be utilized with multi-ring notebook binders utilizing "C"-ring or "D"-ring binding technology.

Figure 5:
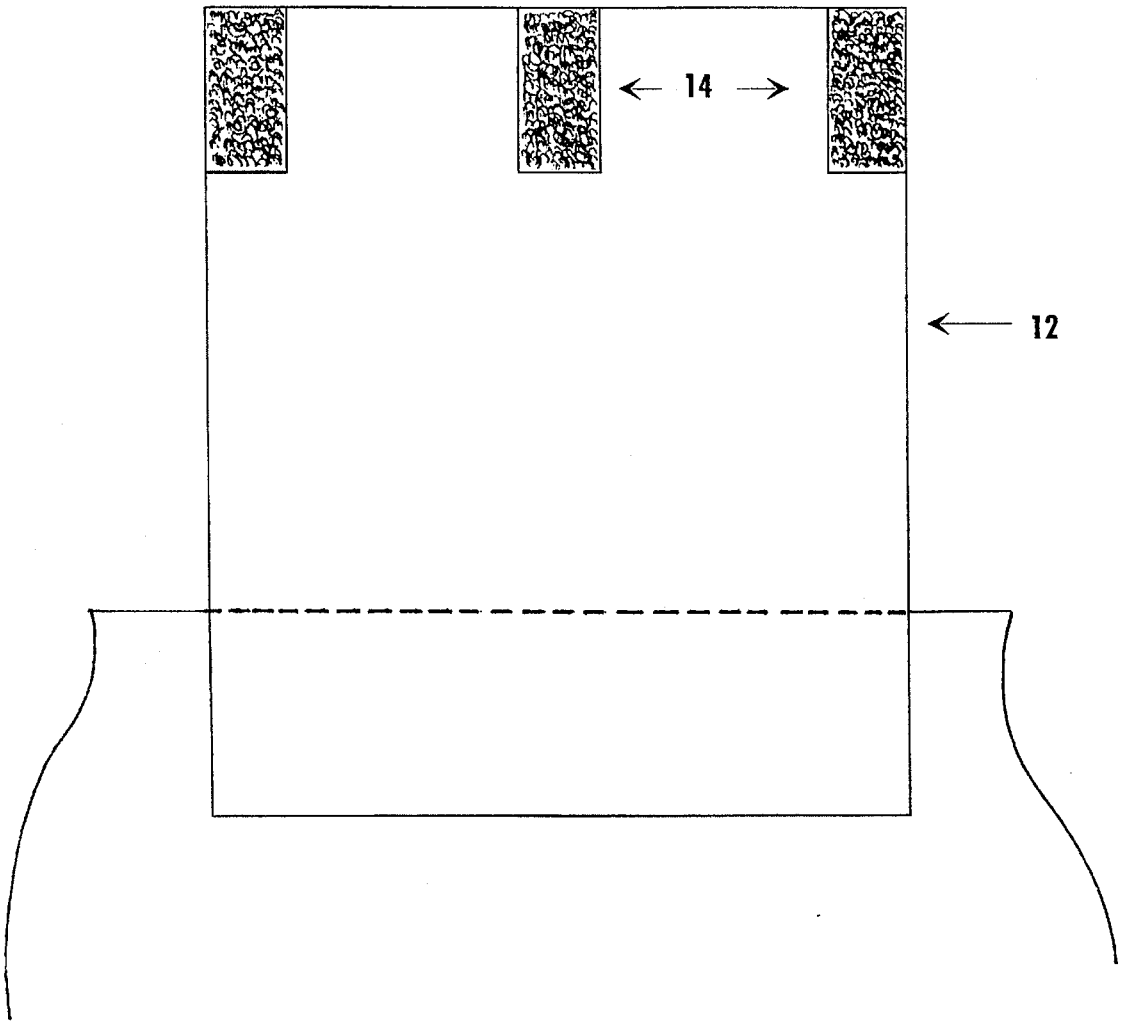

FIG. 5 shows an aerial view of the back side of the Deluxe binding strap permanently affixed to the rear portion of the posterior backing board.

Ten (10) color photographs have been submitted with this application as visual reference material for the examiner. As such, said color photographs are expressly not made part of this application as "drawings." Only those drawings contained within FIGS. 1 through 5 are made part of this application.

DESCRIPTION

The present invention is directed to an apparatus that is capable of retaining and reinforcing the loose-leaf pages or contents of multi-ring notebook binders, whether the binders utilize a "C"-ring, "D"-ring, "Slant"-ring or other edge binding technology. The invention may be utilized in one (1) of four (4) different and distinct manners. First, as an Economy Model apparatus for retaining and reinforcing loose-leaf pages or contents bound in a multi-ring notebook binder utilizing either "C"-ring or "D"-ring binding technology. Second, as a Deluxe Model apparatus for retaining and reinforcing loose-leaf pages or contents bound in a multi-ring notebook binder utilizing either "C"-ring or "D"-ring binding technology. Third, as an Economy Model apparatus for retaining and reinforcing loose-leaf pages or contents bound in a multi-ring notebook binder utilizing "Slant"-ring binding technology. Fourth, as a Deluxe Model apparatus for retaining and reinforcing loose-leaf pages or contents bound in a multi-ring notebook binder utilizing "Slant"-ring binding technology. The invention is the first apparatus capable of retaining and reinforcing the loose-leaf pages or contents of multi-ring notebook binders, whether the binders utilize a "C"-ring, "D"-ring, "Slant"-ring or other edge binding technology.

The invention may first be categorized regarding the type of binding technology utilized by the multi-ring notebook binder to be utilized with the invention. The first category of the invention would involve "C"-ring and "D"-ring binding technology and the second category of the invention would involve "Slant"-ring binding technology. The second tier of categorization of the invention would involve the model of the invention. The first model would be Economy and the second model would be Deluxe.

Variation 1—"C"-ring/"D"-ring—Economy Model

The invention is comprised of one (1) flat, rectangular, pre-slotted, anterior backing board, as shown in FIG. 1, and one (1) flat, rectangular, pre-slotted, posterior backing board, as shown in FIG. 2. Both the anterior and the posterior backing boards contain oval-shaped slots on the left side of the backing boards (Item 2 in FIG. 1), when viewed in the "portrait" position, to fit the rings of a "C"-ring or "D"-ring notebook binder. Both the anterior and the posterior backing boards contain concave comers (Item 3 in FIG. 1) on the left side of the backing boards, when viewed in the "portrait" position with the oval-shaped slots down the left side of the board. Both the anterior and the posterior backing boards contain curved corners (Item 4 in FIG. 1) on the right side of the backing boards, when viewed in the "portrait" position with the oval-shaped slots down the left side of the board.

The front portion of the anterior backing board contains six (6) Velcro® receiving strips (hooks) (Item 1 in FIG. 1), and permanently affixed in a parallel manner, with three (3) of the receiving strips (hooks) above the centerline of the anterior backing board, and three (3) of the receiving strips (hooks) below the centerline of the anterior backing board.

The rear portion of the posterior backing board (shown in FIG. 2) contains six (6) binding straps (Item 8 in FIG. 2), with one (1) end of three (3) of the binding straps being permanently affixed in a parallel manner along the top of the rear portion of the posterior backing board, and one (1) end of three (3) of the binding straps being permanently affixed along the bottom of the rear portion of the posterior backing board, when viewed in the portrait position with the oval-shaped slots down the right side of the board. The end of each of the six (6) binding straps not permanently affixed to the rear portion of the posterior backing board, and on the same side of the binding strap that is permanently affixed to the rear portion of the posterior backing board, contains a Velcro® fastener (loop) (Item 6 in FIG. 2), which is to be affixed to the Velcro® receiving strips (hooks) (Item 1 in FIG. 1) permanently affixed to the anterior backing board. The end of each of the six (6) binding straps not permanently affixed to the rear portion of the posterior backing board, and on the opposite, or exposed, side of the binding strap that is permanently affixed to the rear portion of the posterior backing board, contains a Velcro® fastener (loop) (Item 5 in FIG. 2) which is to be affixed to one of six (6), high Velcro® receiving strips (hooks) (Item 7 in FIG. 2) permanently affixed to the rear portion of the posterior backing board in an opposing, parallel manner, with three (3) of the receiving strips (hooks) affixed above the centerline of the rear portion of the posterior backing board, and three (3) of the receiving strips (hooks) affixed below the centerline of the rear portion of the posterior backing board, to store the binding straps when not in use.

Variation 2—"C"-ring/"D"-ring—Deluxe Model

The invention is comprised of one (1) flat, rectangular, pre-slotted, anterior backing board, as shown in FIG. 4, and one (1) flat, rectangular, pre-slotted, posterior backing board, as shown in FIG. 5. Both the anterior and the posterior backing boards contain oval-shaped slots on the left side of the backing boards (Item 2 in FIG. 4), when viewed in the "portrait" position, to fit the rings of a standard "C"-ring or "D"-ring notebook binder. Both the anterior and the posterior backing boards contain concave corners (Item 3 in FIG. 4) on the left side of the backing boards, when viewed in the "portrait" position. Both the anterior and the posterior backing boards contain curved comers (Item 4 in FIG. 4) on the right side of the backing boards, when viewed in the "portrait" position with the oval-shaped slots down the left side of the board.

The front portion of the anterior backing board contains six (6) Velcro® receiving strips (hooks) (Item 1 in FIG. 4), and permanently affixed in a parallel manner, with three (3) of the receiving strips (hooks) above the centerline of the anterior backing board, and three (3) of the receiving strips (hooks) below the centerline of the anterior backing board.

The rear portion of the posterior backing board (shown in FIG. 5) contains two (2) binding straps (Item 12 in FIG. 5), with one (1) end of one (1) of the binding straps being permanently affixed in a parallel manner along the top of the rear portion of the posterior backing board, and one (1) end of the other binding strap being permanently affixed along the bottom of the rear portion of the posterior backing board, when viewed in the portrait position with the oval-shaped slots down the right side of the board. The end of each of the two (2) binding straps not permanently affixed to the rear portion of the posterior backing board, and on the same side of the binding strap that is permanently affixed to the rear portion of the posterior backing board, contains three (3) Velcro® fasteners (loops) (Item 14 in FIG. 5), which are to be affixed to the Velcro® receiving strips (hooks) (Item 1 in FIG. 4) permanently affixed to the anterior backing board. The end of each of the two (2) binding straps not permanently affixed to the rear portion of the posterior backing board, and on the opposite, or exposed side of the binding strap that is permanently affixed to the rear portion of the posterior backing board, contain three (3) Velcro® fasteners (loops) (Item 13 in FIG. 4) which are to be affixed to one of six (6) Velcro® receiving strips (hooks) (Item 7 in FIG. 2)permanently affixed to the rear portion of the posterior backing board in an opposing, parallel manner, with three (3) of the receiving strips (hooks) affixed above the centerline of the rear portion of the posterior backing board, and three (3) of the receiving strips (hooks) affixed below the centerline of the rear portion of the posterior backing board, to store the binding straps when not in use.

Variation 3—"Slant"-ring—Economy Model

The invention is comprised of one (1) flat, rectangular, pre-slotted, anterior backing board (as shown in FIG. 3) and one (1) flat, rectangular, pre-slotted, posterior backing board (reference FIG. 2). The anterior backing board contains oval-shaped slots (Item 11 in FIG. 3) on the left side of the backing boards, when viewed in the "portrait" position, to fit the rings of a "Slant"-ring notebook binder. The extended nature of the oval-shaped slot allows the anterior backing board to traverse the length of the "Slant"-ring while at the same time remaining in spatial alignment with the posterior backing board. The anterior backing board contains concave comers (Item 9 in FIG. 3) on the left side of the backing board, when viewed in the "portrait" position with the oval-shaped slots down the left side of the board.

The posterior backing board contains oval-shaped slots (Item 2 in FIG. 1) on the left side of the backing board, when viewed in the "portrait" position, to fit the rings of a "Slant"-ring notebook binder. The posterior backing board contains concave comers (Item 3 in FIG. 1) on the left side of the backing board, when viewed in the "portrait" position with the oval-shaped slots down the left side of the board.

Both the anterior and the posterior backing boards contain curved corners (Item 10 in FIG. 3) on the right side of the backing boards, when viewed in the "portrait" position with the oval-shaped slots down the left side of the board.

The front portion of the anterior backing board contains six (6) Velcro® receiving strips (hooks) (Item 1 in FIG. 3), and permanently affixed in a parallel manner, with three (3) of the receiving strips (hooks) above the centerline of the anterior backing board, and three (3) of the receiving strips (hooks) below the centerline of the anterior backing board.

The rear portion of the posterior backing board (reference FIG. 2) contains six (6) binding straps (reference Item 8 in FIG. 2), with one (1) end of three (3) of the binding straps being permanently affixed in a parallel manner along the top of the rear portion of the posterior backing board, and one (1) end of three (3) of the binding straps being permanently affixed along the bottom of the rear portion of the posterior backing board, when viewed in the portrait position with the oval-shaped slots down the right side of the board. The end of each of the six (6) binding straps not permanently affixed to the rear portion of the posterior backing board, and on the same side of the binding strap that is permanently affixed to the rear portion of the posterior backing board, contains a Velcro® fastener (loop) (reference Item 6 in FIG. 2), which is to be affixed to the Velcro® receiving strips (hooks) (Item 1 in FIG. 3) permanently affixed to the anterior backing board. The end of each of the six (6) binding straps not permanently affixed to the rear portion of the posterior backing board, and on the opposite, or exposed side of the binding strap that is permanently affixed to the rear portion of the posterior backing board, contains a Velcro® fastener (loop) (reference Item 5 in FIG. 2) which is to be affixed to one of six (6) Velcro® receiving strips (hooks) (reference Item 7 in FIG. 2) permanently affixed to the rear portion of the posterior backing board in an opposing, parallel manner, with three (3) of the receiving strips (hooks) affixed above the centerline of the rear portion of the posterior backing board, and three (3) of the receiving strips (hooks) affixed below the centerline of the rear portion of the posterior backing board, to store the binding straps when not in use.

Variation 4—"Slant"-ring—Deluxe Model

The invention is comprised of one (1) flat, rectangular, pre-slotted, anterior backing board (as shown in FIG. 3) and one (1) flat, rectangular, pre-slotted, posterior backing board (as shown in FIG. 5). The anterior backing board contains oval-shaped slots (Item 11 in FIG. 3) on the left side of the backing boards, when viewed in the "portrait" position, to fit the rings of a "Slant"-ring notebook binder. The extended nature of the oval-shaped slot allows the anterior backing board to traverse the length of the "Slant"-ring while at the same time remaining in spatial alignment with the posterior backing board. The anterior backing board contains concave comers (Item 9 in FIG. 3) on the left side of the backing board, when viewed in the "portrait" position with the oval-shaped slots down the left side of the board.

The posterior backing board contains oval-shaped slots (Item 2 in FIG. 1) on the left side of the backing board, when viewed in the "portrait" position, to fit the rings of a "Slant"-ring notebook binder. The posterior backing board contains concave comers (Item 3 in FIG. 1) on the left side of the backing board, when viewed in the "portrait" position with the oval-shaped slots down the left side of the board.

Both the anterior and the posterior backing boards contain curved comers (Item 4 in FIG. 4) on the right side of the backing boards, when viewed in the "portrait" position with the oval-shaped slots down the left side of the board.

The front portion of the anterior backing board contains six (6) Velcro® receiving strips (hooks) (Item 1 in FIG. 3), and permanently affixed in a parallel manner, with three (3) of the receiving strips (hooks) above the centerline of the anterior backing board, and three (3) of the receiving strips (hooks) below the centerline of the anterior backing board.

The rear portion of the posterior backing board contains two (2) binding straps (Item 12 in FIG. 5), with one (1) end of one (1) of the binding straps being permanently affixed in a parallel manner along the top of the rear portion of the posterior backing board, and one (1) end of the other binding strap being permanently affixed along the bottom of the rear portion of the posterior backing board, when viewed in the portrait position with the oval-shaped slots down the right side of the board. The end of each of the two (2) binding straps not permanently affixed to the rear portion of the posterior backing board, and on the same side of the binding strap that is permanently affixed to the rear portion of the posterior backing board, contain three (3) Velcro® fasteners (loops) (Item 14 in FIG. 5), which are to be affixed to the Velcro® receiving strips (hooks) (Item 1 in FIG. 4) permanently affixed to the anterior backing board. The end of each of the two (2) binding straps not permanently affixed to the rear portion of the posterior backing board, and on the opposite, or exposed, side of the binding strap that is permanently affixed to the rear portion of the posterior backing board, contains three (3), Velcro® fasteners (loops) (Item 13 in FIG. 4) which are to be affixed to one of six (6), Velcro® receiving strips (hooks) (Item 7 in FIG. 2) permanently affixed to the rear portion of the posterior backing board in an opposing, parallel manner, with three (3) of the receiving strips (hooks) affixed above the centerline of the rear portion of the posterior backing board, and three (3) of the receiving strips (hooks) affixed below the centerline of the rear portion of the posterior backing board, to store the binding straps when not in use. The left side of the first two (2) opposing three-quarters of an inch (½") wide by one-half inch (b ½") high Velcro® receiving strips (hooks) are placed one inch (1") from the left side boundary of the rear portion of the posterior backing board.

FIG. 1 graphically illustrates the spatial relationships of the dimensions of the front portion of the anterior backing board of Variation 1 or Variation 2. FIG. 2 graphically illustrates the spatial relationships of some of the dimensions, including the binding straps, of the rear portion of the posterior backing board of Variation 1 and 3, as well as the reverse side of the binding strap containing the Velcro® fastener (loop). FIG. 3 graphically illustrates the spatial relationships of some of the dimensions, including the receiving straps (hooks), of the front portion of the anterior backing board of Variation 3 or Variation 4. FIG. 4 graphically illustrates the spatial relationships of the dimensions of the Deluxe binding strap affixed to the front portion of the anterior backing board. FIG. 5 graphically illustrates the spatial relationships of the dimensions of the Deluxe binding strap permanently affixed to the rear portion of the posterior backing board.

Although certain preferred embodiments of the present invention have been described, the spirit and scope of the invention is by no means restricted to what is described above. The width, length and number of the binding straps and receiving strips (hooks) may be increased or decreased, apparatuses may be constructed to work with notebook binders containing more or less then three (3) rings, or other binding technologies, and/or the backing boards may be constructed of a myriad of materials. Therefore, the permutations and combinations available regarding the binding straps, receiving strips (hooks), number of binder rings and construction material of the apparatus are almost limitless.

What is claimed is:

1. Apparatus for retaining and reinforcing pages held in a multi-ring notebook binder, said binder utilizing "C"-ring, "D"-ring, or "Slant"-ring binding technology, the apparatus comprising:

(a) one flat, rectangular anterior backing board and one flat, rectangular posterior backing board, each of said backing boards including slots therein which are positioned to align with the rings of said binder;

(b) the anterior backing board including six hook-type receiving strips affixed thereto, three of said receiving strips disposed in parallel alignment above the horizontal centerline of the anterior backing board, and the other three of said receiving strips disposed in parallel alignment below the horizontal centerline of the anterior backing board; and (c) the posterior backing board including six binding straps, one end of each of the binding straps being permanently affixed to the posterior backing board and the other end of each of the binding straps being disassociated from and movable relative to said posterior backing board, three of said binding straps affixed to the posterior backing board in parallel alignment above the horizontal centerline of the posterior backing board, and the other three binding straps affixed to the posterior backing board in parallel alignment below the horizontal centerline of the posterior backing board; three hook-type receiving strips permanently affixed to the posterior backing board and located directly above the horizontal centerline of the posterior backing board, and three hook-type receiving strips permanently affixed to the posterior backing board and located directly below the horizontal centerline of the posterior backing board; said one end of each of the binding straps including loop-type fasteners on one side thereof for attachment to a corresponding hook-type receiving strip affixed to the anterior backing board to capture said pages between said anterior and posterior backing boards, and said one end of each of the binding straps further including loop-type fasteners on an opposite side thereof for attachment to a corresponding hook-type receiving strip affixed to the posterior backing board for storing said binding straps when not in use.

2. The apparatus as claimed in claim 1, wherein said pages held in said binder include either 8½"×11" loose-leaf paper, plastic or vinyl sheet protectors, or multi-pocketed plastic or vinyl sheet protectors, or any combination thereof.

3. The apparatus as claimed in claim 1, wherein said backing boards are composed of a heavy gauge plastic material.

4. The apparatus as claimed in claim 1, wherein said binding straps are of sufficient length to capture pages in said binder up to a thickness of approximately four inches.

5. Apparatus for retaining and reinforcing pages held in a multi-ring notebook binder, said binder utilizing "C"-ring, "D"-ring, or "Slant"-ring binding technology, the apparatus comprising:

(a) one flat, rectangular anterior backing board and one flat, rectangular posterior backing board, each of said backing boards including slots therein which are positioned to align with the rings of said binder;

(b) the anterior backing board including two binding strips affixed thereto, one of said binding strips disposed above the horizontal centerline of the anterior backing board, and the other of said binding strips disposed below the horizontal centerline of the anterior backing board; each binding strip including three hook-type receiving strips affixed thereto in parallel, spaced relation; and (c) the posterior backing board including two binding straps, one end of each of the binding straps being permanently affixed to the posterior backing board and the other end of each of the binding straps being disassociated from and movable relative to said posterior backing board, one of said binding straps affixed to the posterior backing board above the horizontal centerline of the posterior backing board, and the other of said binding straps affixed to the posterior backing board below the horizontal centerline of the posterior backing board; three hook-type receiving strips permanently affixed to the posterior backing board and located directly above the horizontal centerline of the posterior backing board, and three hook-type receiving strips permanently affixed to the posterior backing board and located directly below the horizontal centerline of the posterior backing board; said one end of each of the binding straps including three loop-type fasteners in spaced, parallel relation on one side thereof for attachment to corresponding hook-type receiving strips affixed to the anterior backing board to capture said pages between said anterior and posterior backing boards, and said one end of each of the binding straps further including three loop-type fasteners in spaced, parallel relation on an opposite side thereof for attachment to corresponding hook-type receiving strips affixed to the posterior backing board for storing said binding straps when not in use.

6. The apparatus as claimed in claim 5, wherein said pages held in said binder include either 8½×11 loose-leaf paper, plastic or vinyl sheet protectors, or multi-pocketed plastic or vinyl sheet protectors, or any combination thereof.

7. The apparatus as claimed in claim 5, wherein said backing boards are composed of a heavy gauge plastic material.

8. The apparatus as claimed in claim 5, wherein said binding straps are of sufficient length to capture pages in said binder up to a thickness of approximately four inches.

* * * * *